US005092041A

United States Patent [19]

Podolsky

[11] Patent Number: 5,092,041

[45] Date of Patent: Mar. 3, 1992

[54] UNIVERSAL SHAVING DEVICE

[76] Inventor: Grigory Podolsky, 35-53 82 St. #3H, Jackson Heights, N.Y. 11372

[21] Appl. No.: 712,512

[22] Filed: Jun. 10, 1991

[51] Int. Cl.[5] ..... B26D 19/44

[52] U.S. Cl. ..... 30/41; 30/34.2; 30/45

[58] Field of Search ..... 30/32, 34.05, 41, 45, 30/85, 86, 90, 34.2

[56] References Cited

U.S. PATENT DOCUMENTS 3,032,803 8/1962 Walshauser ..... 30/41
3,252,217 5/1966 Werft ..... 30/41
3,417,468 12/1968 Miyauchi ..... 30/41
5,022,154 6/1991 Johnson ..... 30/34.05 X

*Primary Examiner*—Douglas D. Watts

[57] ABSTRACT

A shaving device has a handle with an inner chamber for accommodating a shaving cream, a head connected with the handle and having a passage for supplying the shaving cream and massaging and vibration elements, brushes on the head for distributing the shaving cream discharged from the head over the skin of the user, and a shaving element on the head for shaving after the application of the shaving cream and container for refreshing and disinfection.

18 Claims, 2 Drawing Sheets

UNIVERSAL SHAVING DEVICE

BACKGROUND OF THE INVENTION

The present invention generally relates to shaving devices. Shaving devices of different types are known in the art. Usually, during the use of the shaving device with razor blades, first the user applies a shaving cream on the skin and distributes it over the skin, and then the shaving device with the razor is used to shave the hair. The known shaving devices possess several disadvantages. First of all, they are not used for applying and distributing the shaving cream on the skin. It is necessary to apply and distribute the shaving cream on the skin by an additional device or by hand which is inconvenient and unpleasant. The known shaving devices with razor blades do not massage the user's skin during shaving. Also, if the user wants to refresh and disinfect its skin with cologne, an additional device must be used. It is therefore desirable to improve the existing shaving devices.

SUMMARY OF THE INVENTION

Accordingly, it is an object of the present invention to provide a new and improved shaving device, which avoids the disadvantages of the prior art. In keeping with these objects and with others which will become apparent hereinafter, one feature of the present invention resides, briefly stated, in a shaving device which has a hollow handle with a replaceable container, a head, means for supplying the shaving cream from a replaceable container of the handle through the head onto the user's skin, brush means for distributing the shaving cream on the user's hair, shaving means for shaving after the application of the shaving cream on the skin of the user.

When the shaving device is designed in accordance with the present invention it simultaneously applies and distributes the shaving cream and shaves the hair on the user's skin. When the shaving device is provided with additional refreshing substance storing and applying means, it refreshes and disinfects the skin after shaving has been completed. When the shaving device is provided with additional massaging means, it also massages the skin which further improves the quality of shaving. The inventive device is easy to wash, and convenient to use since it simultaneously performs several operations.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
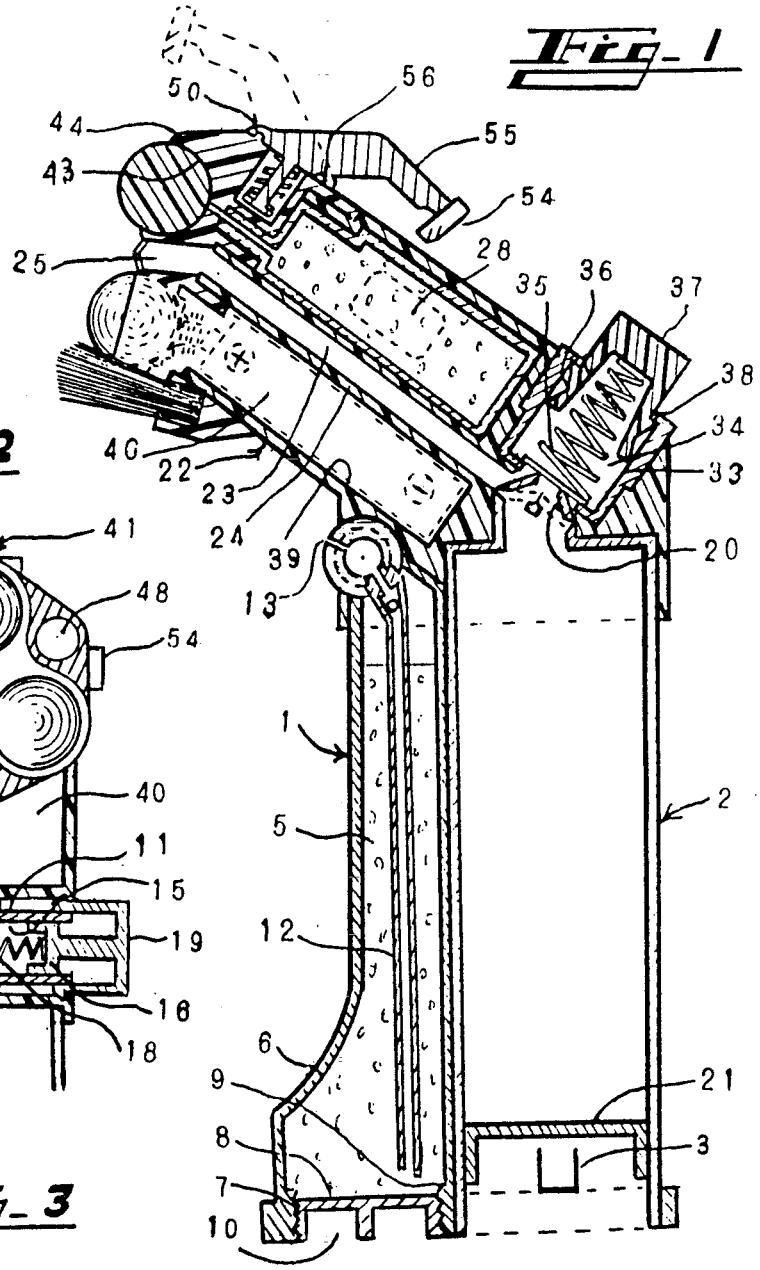
FIG. 1 is a side view of a new shaving device in accordance with the present invention.
Figure 2:
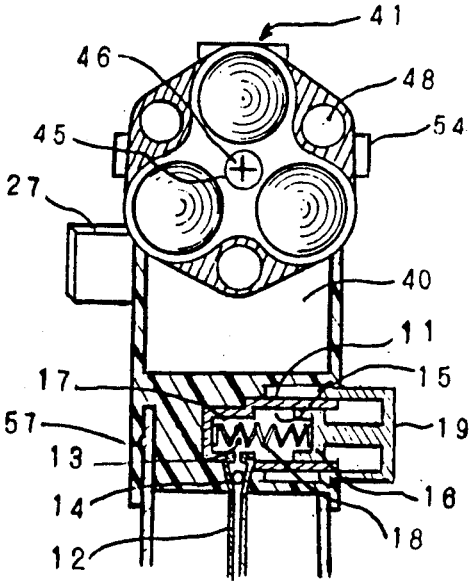
FIG. 2 is a frontal view of a head and a central unit with a sprayer.
Figure 3:
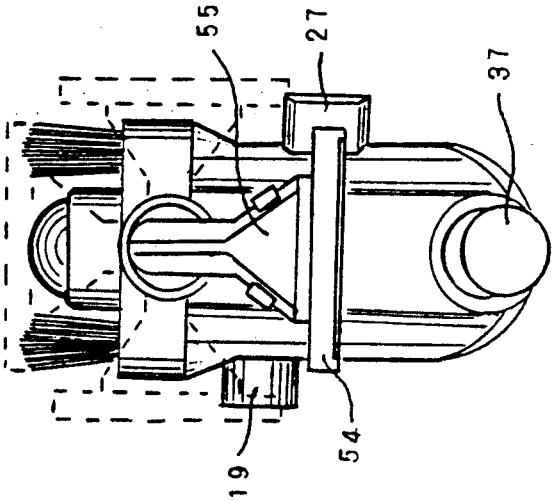
FIG. 3 is a top view of a new shaving device in accordance with the present invention.
Figure 4:
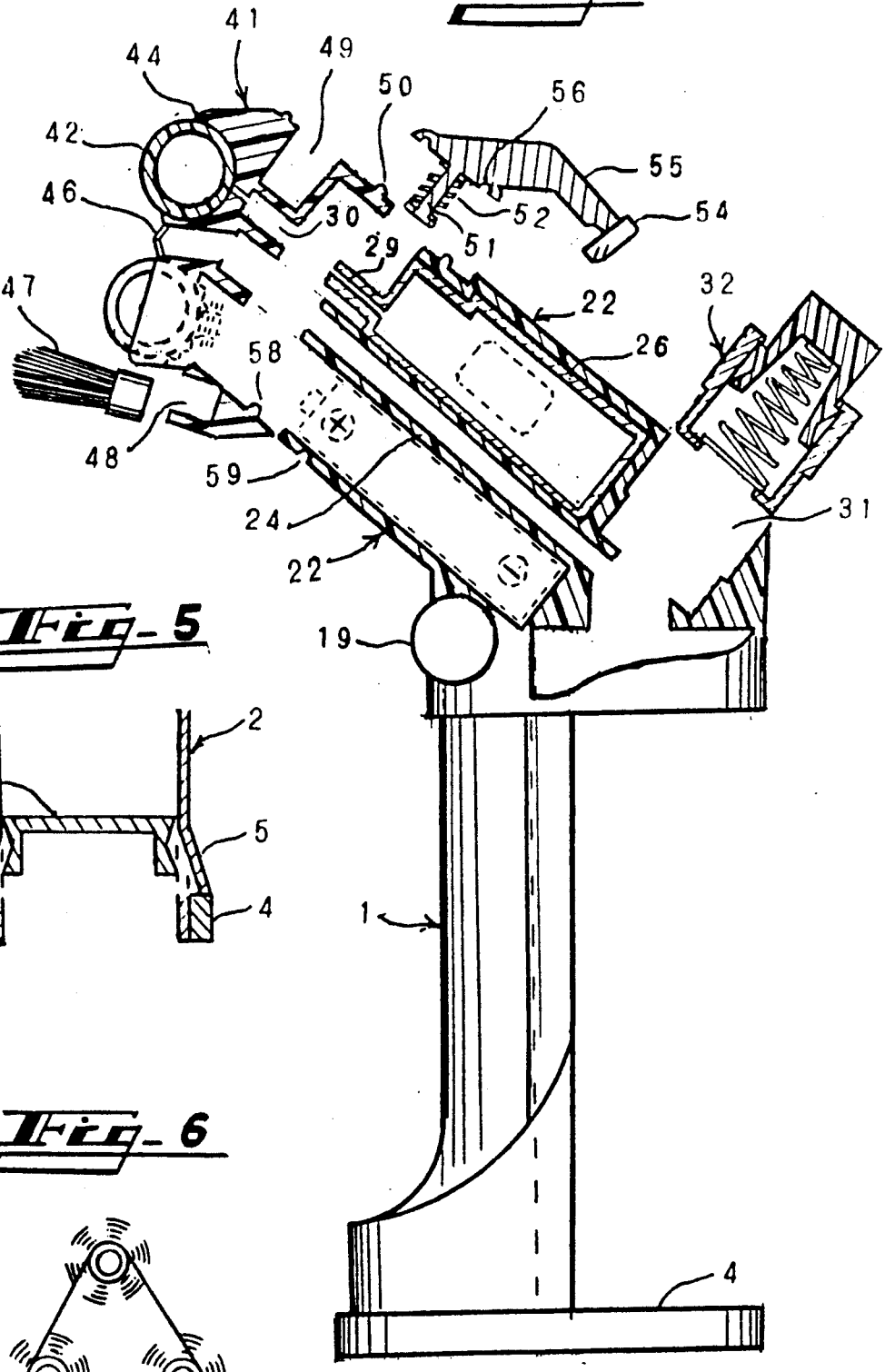
FIG. 4 is a view illustrating a sequence of connection of parts of the inventive device.
Figure 5:
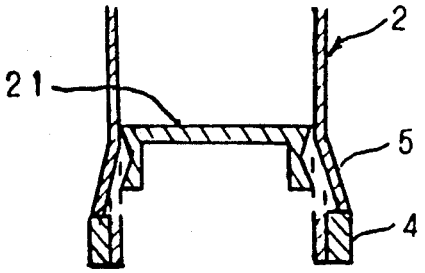
FIG. 5 shows a fixation of a container inside a handle.
Figure 6:
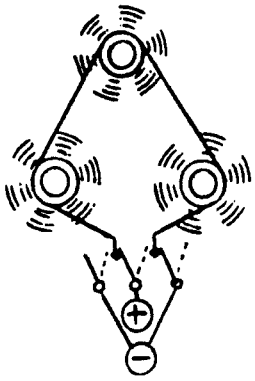
FIG. 6 is a schematic view of a device for vibration.

A shaving device in accordance with the present invention has a handle which is identified as a whole with reference number 1. The handle 1 has a replaceable container 2 which is inserted in the handle 1. The replaceable container 2 has two inter-engaging projections 3 which are connected with a hollow circular or oval part 4. The handle 1 has an inner hollow 5 with a wider part 6 provided with an inner thread 7. The inner hollow is closable by a plug 8 having an outer thread 9 cooperating with the inner thread 7. The inner hollow is filled with a refreshing substance such as cologne (for example) through an opening 10. It is also possible to use a valve for closing the opening 10. The inner hollow 5 is connected with an atomizer 11 by a pipe 12 extending into the reservoir. The atomizer 11 includes a sprayer 13 a valve member 14, a cylinder 15, a piston 16, another cylinder 17, a spring 18 and a push button 19. The replaceable container 2 has a flat valve 20 on the top of the container and on the bottom it has a piston 21. A central unit 22 is a connecting element between the head and the handle. It includes a shaped hollow 23 with an inlet pipe 24 for an opening 25 provided in the head. An elastic reservoir 26 is inserted in the top of the shaped hollow 23 and a push button 27 is arranged in a opening 28, in the body of a central unit.

The reservoir is connected by an opening 29 to the opening 30 of the head. The rear side of the central unit has an opening 31 in which a pump 32 is inserted. The pump 32 has a cylinder 33 with an opening 34, a spring 35, and a piston 36 with a push button 37, a ring 38 for fixation of piston 36 inside the cylinder 33. On the bottom of the central unit there is an inner hollow 39 in which bodies of cells 40 are inserted for vibration of the blades of a shaving element or rotatable blades of a massaging means. The head 41 is mounted on the handle. The head is preferably composed of a heat retaining material. Balls or rotatable bodies 42 are inserted in a recess 43 and retained in the recess 43 by shoulders 44 projecting slightly beyond the maximum radius of the balls. It is possible to use the balls 42 with inner hollows. The opening 30 is connected with the recess 43. Located in the central part of the head is the valve 45 with flaps 46. Brushes 47 are insertable in a recess 48 formed at the sides of the head. The brushes 47 project forwardly somewhat beyond the front surface of the balls 42.

The head is provided with an opening 49 and two projections 50 are provided with for fixing a shaving element in the neutral non-working position, in the side view and the frontal view working positions. The connection includes a bolt 51, a spring 52, and a screw 53 while a shaving element 54 has a clamp 55 and a projection 56. The handle is connected with the central unit by projections 57 and a head connected with the central unit by projections 58 and 59.

The device operates in the following way: First of all, the head is inserted into warm water for heating of the head. Simultaneously, the button 27 is depressed and the reservoir 26 is compressed. When the button 27 is released, warm water is aspirated in the reservoir 26. The push button 37 of the pump is depressed. The flat valve 20 is closed and the shaving cream is aspirated through the pipe 24 and there after through the valve 45 outside to the center of the head. When the push button 37 is released under the negative pressure, the flap 46 closes the opening valve 45, and prevents the shaving cream from becoming a stockstill. Also the flap of the valve 20 is opened and the shaving cream under negative pressure is supplied to the pump 32. The head is brought into contact with the user's skin.

The shaving cream is expelled onto the skin, and the head is moved along the skin. The brushes 47 uniformly distribute the shaving cream and produce a foam on the skin. If needed, the additional water is supplied for producing the foam by depressing the button 27 so that water is aspirated outside from the reservoir 26 through the opening 29 and 30, and the available space between the ball 42 and the recess 43.

The water is mixed with shaving cream to make a foam. The balls 42 warm the skin and provide additional massage. When the skin is covered by foam the user turns the shaving element 54 with the clamp 55 around its axis by 180 or 90 degrees. (as convenient for the user), and fixes the clamp by projections 50 and 56. It is possible to provide additional vibration of the shaving element with the use of the cells 40. After shaving, the button of the atomizer is depressed several times and the refreshing or disinfective substance is expelled onto the users skin and the is distributed by the rotational body (balls 42) with additional massage.

The refilling of the atomizer is performed through the opening 10 which is closable by the plug 8 provided with an outer thread 9 cooperating with the inner thread 7.

The replaceable container 2 is retained in the hollow or oval part 4 by the projections 3 and could be easily released by pushing the projections 3. The container can be replaced.

The invention is not limited to the details shown, since various modifications and structural changes are possible without departing in any way.

What is desired to be protected by Letters Patent is set forth in the appended claims.

I claim:

1. A shaving device, comprising a handle with a replaceable container for accommodating shaving cream; a head connected with said handle and having passage means for passing shaving cream supplied from said replaceable container of said handle through said head and outwardly of the latter; means for supplying shaving cream from said handle to said head and outwardly of the latter; shaving means provided on said head for shaving after application of shaving cream on a skin of a user; and means for vibrating said shaving means.

2. A shaving device as defined in claim 1; and further comprising brush means provided on said head for distributing shaving cream discharged from said head over the skin of the user.

3. A shaving device as defined in claim 1; and further comprising means for massaging the skin of the user.

4. A shaving device as defined in claim 1; and further comprising means for aspirating water into said head and then expelling water from said head outwardly on the skin of the user.

5. A shaving device as defined in claim 4, wherein said means for aspirating water include an elastic reservoir arranged in said head and a member actuatable by the user and alternatingly compressing and releasing said reservoir to aspirate water.

6. A shaving device as defined in claim 1; and further comprising means for supplying a refreshing substance on the skin of the user.

7. A shaving device as defined in claim 6, wherein said means for supplying a refreshing substance include a reefreshing substance accommodating reservoir, and means for delivering the refreshing substance from said reservoir to said head and expelling the same on the skin of the user.

8. A shaving device as defined in claim 7, wherein said refreshing substance accommodating reservoir is arranged in said handle.

9. A shaving device as defined in claim 7, wherein said delivering means include an atomizer communicating with said refreshing substance accommodating reservoir.

10. A shaving device as defined in claim 1, wherein said means for supplying shaving cream include a pump and a bottom activating said pump to aspirate shaving cream from said replaceable container of said handle and to supply shaving cream to said head and outwardly on the skin of the user.

11. A shaving device as defined in claim 10; and further comprising a valve through which shaving cream is supplied outwardly and which prevents contact of shaving cream with air.

12. A shaving device as defined in claim 2, wherein said shaving means is turnable between a first retracted position in which it is retracted rearwardly of said head so that shaving cream can be first applied on the skin of the user and said brush means can distribute shaving cream on the skin of the user, and a second position forwardly of said head for shaving the user's hair.

13. A shaving device as defined in claim 12, and further comprising means for fixing the shaving means in said positions.

14. A shaving device as defined in claim 1, wherein said means for vibrating said shaving means includes battery cells.

15. A shaving device as defined in claim 1, wherein said massaging means include at least one rotatable body.

16. A shaving device as defined in claim 1, wherein said vibrating means is operative for vibrating said rotatable body of said massaging means.

17. A shaving device as defined in claim 16, wherein said vibrating means include a membrance connected with said rotatable body and vibrating under the action of a magnetic field si as to vibrate said rotatable body.

18. A shaving device as defined in claim 1, wherein said handle has a lower part, said replaceable container having projections engaging with said lower part.

* * * * *